US006263045B1

(12) United States Patent
Lipkin et al.

(10) Patent No.: US 6,263,045 B1
(45) Date of Patent: Jul. 17, 2001

(54) HIGH REFLECTIVITY CATHODE CUPS FOR X-RAY TUBE APPLICATIONS

(75) Inventors: Don Mark Lipkin, Niskayuna; Thomas Robert Raber, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/489,125

(22) Filed: Jan. 21, 2000

(51) Int. Cl.[7] ..... H01J 9/04; H01J 19/06; H01J 35/06

(52) U.S. Cl. ..... 378/136; 378/142; 313/311; 313/340; 313/355; 445/51

(58) Field of Search ..... 378/146, 121, 378/142; 313/340, 339, 346 R, 346 DC, 355, 311; 445/51

(56) References Cited

U.S. PATENT DOCUMENTS

| | | | | |
|---|---|---|---|---|
| 3,560,790 | * | 2/1971 | Vollmer et al. | 313/355 |
| 3,958,146 | | 5/1976 | Buescher et al. . | |
| 4,673,842 | | 6/1987 | Grieger et al. | 313/311 |
| 5,171,180 | * | 12/1992 | Lee | 445/51 |

OTHER PUBLICATIONS

Carver, GE, "Chemically Vapor Deposited Molybdenum Films of High Infrared Reflectance", *Thin Solid Films*, 63[1] 169–174 (1979).

Carver, GE; Seraphin, BO, "Chemical–Vapor–Deposited Molybdenum Films of High Infrared Reflectance", *Appl. Phys. Lett.*, 34 [4] 279–281 (1979).

Carver, GE; Allred, DD; Seraphin, BO, "Chemical Vapor Deposited Molybdenum Films For Use In Photothermal Conversion", Proceedings of the Society of Photo–Optical Instrumentation Engineers; *Optics Applied to Solar Energy IV*, 161, 66–71. Masterson, KD, Bellingham, Eds., Soc. Photo–Optical Instrumentation Engrs., WA (1978).

Chain, ED; Gesheva, KA; Seraphin, BO, "Chemically Vapor–Deposited Black Molybdenum Films Of High IR Reflectance and Significant Solar Absorptance", *Thin Solid Films*, 83 [4] 387–92 (1981).

Carver, GE; Chain, EE, "CVD Molybdenum Films of High Infrared Reflectance and Significant Solar Absorptance", *J. Physique Colloque*, 42 [C–1] 203–11 (1981).

* cited by examiner

*Primary Examiner*—Drew Dunn
(74) *Attorney, Agent, or Firm*—Noreen C. Johnson; Douglas E. Stoner

(57) ABSTRACT

A x-ray tube comprises a cathode cup assembly. The cathode cup assembly comprises a filament positioned in a cathode cup. A surface of the cathode cup assembly is exposed to incident infrared radiation, and the surface is adapted to reflect a substantial portion of the incident radiation, in which the radiation has a wavelength in a range from about 0.2 $\mu$m to about 5.0 $\mu$m.

29 Claims, 3 Drawing Sheets

HIGH REFLECTIVITY CATHODE CUPS FOR X-RAY TUBE APPLICATIONS

BACKGROUND OF THE INVENTION

The present invention relates to cathode cups and electrodes for x-ray tubes. In particular, the invention relates to cathode cups for x-ray tubes, and a method of manufacture of cathode cups.

In high voltage electron beam tubes such as, for example, x-ray tubes, an electron emitter (typically a filament situated in a cathode cup) is caused to emit electrons by heating and simultaneous application of a high voltage thereto. Electron emission may be controlled by varying the filament current and thus the temperature of the filament. Also electron emission can be controlled by use of a "grid" voltage whose potential with respect to the electron emitter, such as but not limited to, a filament may be varied to either accelerate or retard a beam of electrons emitted by the filament. In a x-ray tube, the cathode may comprise a filament, which is heated by electrical current to emit electrons, and a surrounding cathode cup, which acts to focus electrons emitted by the filament, and possibly to act as a grid control. The cathode cup generally has one or more slots within which the filament, typically a helical coil of tungsten wire, is positioned.

In order to release electrons, the metallic filament that is positioned in the cathode cup is electrically heated to incandescence for example by means of the passage of a predetermined current therethrough the current causes thermionic emission of electrons. The released electrons are accelerated by the application of a high voltage between the cathode and the anode of the x-ray tube. Impingement of the accelerated electrons upon a target anode, typically in the form of a rotating target anode, causes deceleration of the electrons thereby producing x-rays. The cathode cup for the cathode assembly can be used to hold the filament to allow electrical current to be supplied thereto. The cathode cup can also act to focus the emitted electrons towards a focal spot on the focal track of the anode target.

Cathode cups presently used in x-ray tubes are typically manufactured from a TZM (titanium-0.5%, zirconium-0.008%, balance molybdenum) alloy. In addition, nickel and non-nickel alloys can be used for the cathode cup in certain metal-framed x-ray tube applications.

A cathode cup is exposed to, and typically absorbs, a portion of the heat generated by the filament as well as the anode focal track, due at least in part to the high temperatures to which the filament and focal track are heated and the proximity of the cathode cup to the hot filament and focal track. The high temperatures to which cathode cups are exposed and the rapid thermal cycling of the cathode may cause a number of problems. In order to withstand such high temperatures resulting from the absorption of radiated heat from the filament and focal track, a cathode cup typically needs be comprised of a material capable of withstanding such temperatures, such as refractory alloys. High cup temperatures can lead to creep deformation of various components of the cathode cup assembly and cathode arm. The high cup temperatures can also lead to increased thermal mismatch and distortion of the joints between the cathode cup and arm, and/or the filament support leads and cup. All of the foregoing may lead to undesirable drift and/or distortion of the focal spot, which are undesirable.

During x-ray tube operation, the cathode cup is heated primarily via absoption of radiation from the incandescent filament. The cathode cup may also be heated, to a lesser extent by the anode focal track. In operation, the filament may become heated to temperature greater than about 2500° C. Although the cathode cup is not in direct contact with the filament, and the filament may be cycled off and on during operation, the cathode cup temperature can rise to about 600° C.

It has been proposed to provide the interior surface of cathode caps in "fast warm-up" cathode ray tubes for televisions with a black or dark gray (non-reflective coating. The coating may increase the rate at which the cathode cap is heated to operating temperatures so it can emit electrons. For example U.S. Pat. No. 3,958,146 ('146) discloses a "fast warm-up" cathode cap for use in a cathode ray tube. In '146, a heater is disposed within the nickel alloy cathode cap, and the cap has an electron emissive material on the outer surface of the closed end for emitting elections. The inner surface is clad with a nichrome material. When the cap and nickel-chromium material covering the inner surface thereof is exposed for about 10 minutes or longer in wet dissociated ammonia at a temperature in a range from about 900° C. to about 1300° C. Thus, the inner surface of the cap oxidizes to form a dark gray or black surface. In operation, the black surface increases the rate at which heat is absorbed into the cap from the heater, thus the rate at which the cap is heated to operating temperatures at which electron emission will occur increases.

U.S. Pat. No. 4,673,842 to Grieger et al., commonly assigned to General Electric Corporation, discloses a cathode cup having a base formed of TZM, and an exposed upper surface of graphite, which is bonded to the base. The graphite upper surface of the cathode cup is coated with pyrolitic carbon or a silicon carbide graphite composition. The pyrolitic carbon or a silicon carbide graphite composition is non-infrared reflective and minimizes dust. It can also eliminate possible welding of the filament to the cathode cup in the event of contact therebetween.

Therefore, a need exists to provide cathode cup structures that overcome the above-noted deficiencies. Further, a need exists to provide enhanced cathode cups for x-ray tubes.

SUMMARY OF THE INVENTION

Thus, one aspect of the invention sets forth a x-ray tube that comprises a cathode cup assembly. The cathode cup assembly comprises a filament positioned in a cathode cup. A surface of the cathode cup assembly is exposed to incident infrared radiation, and the surface is adapted to reflect a substantial portion of the incident radiation, in which the radiation has a wavelength in a range from about 0.2 $\mu$m to about 5.0 $\mu$m.

Another aspect of the invention provides a cathode cup for use in retaining a filament member in a x-ray tube. The cathode cup assembly comprises a filament positioned in a cathode cup. A surface of the cathode cup assembly is exposed to incident infrared radiation, and the surface is adapted to reflect a substantial portion of the incident radiation, in which the radiation has a wavelength in a range from about 0.2 $\mu$m to about 5.0 $\mu$m.

A further aspect of the invention sets forth a method of manufacturing a cathode cup for use in a x-ray tube. The method comprises forming a cathode cup. The cathode cup assembly comprises a filament positioned in a cathode cup. A surface of the cathode cup assembly is exposed to incident infrared radiation, and the surface is adapted to reflect a substantial portion of the incident radiation, in which the radiation has a wavelength in a range from about 0.2 $\mu$m to about 5.0 $\mu$m.

BRIEF DESCRIPTION OF THE DRAWINGS

The invention will be better understood having reference to the accompanying drawings and to the description given here below, wherein.

DETAILED DESCRIPTION OF THE INVENTION

Figure 1:
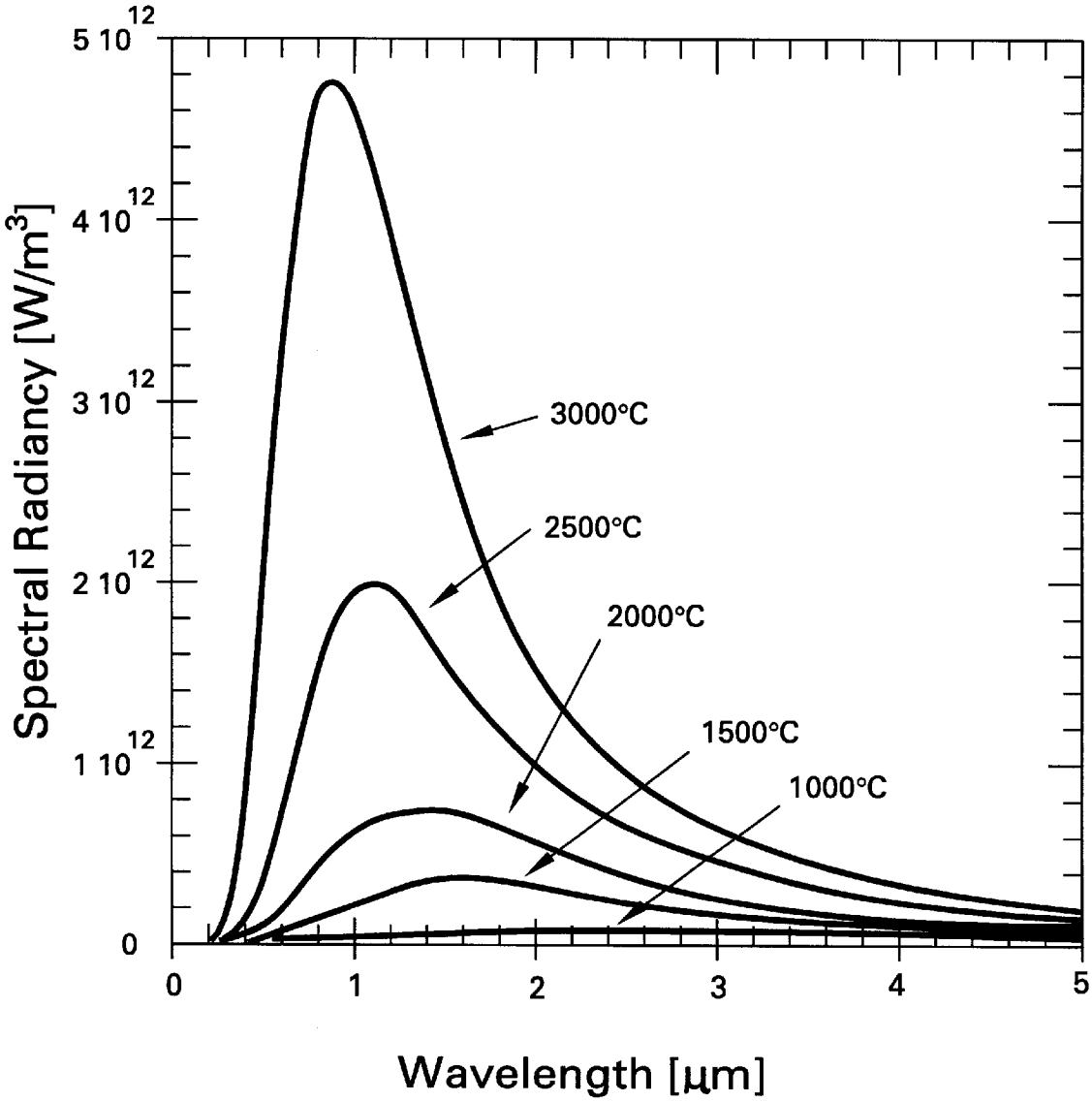
FIG. 1 is a graph of spectral radiancy for cavity radiation plotted as a function of wavelength at five (5) different temperatures.

FIG. 1 illustrates a graph of spectral radiancy (in Watts per cubic meter) versus wavelength emitted from an ideal black body source, for five (5) separate operating temperatures. These curves illustrate that at the temperatures at which filaments typically operate (for example temperatures in a range from about 2400° C. to about 2800° C., the greatest radiant power is emitted at wavelengths of approximately 1 μm.

Figure 2:
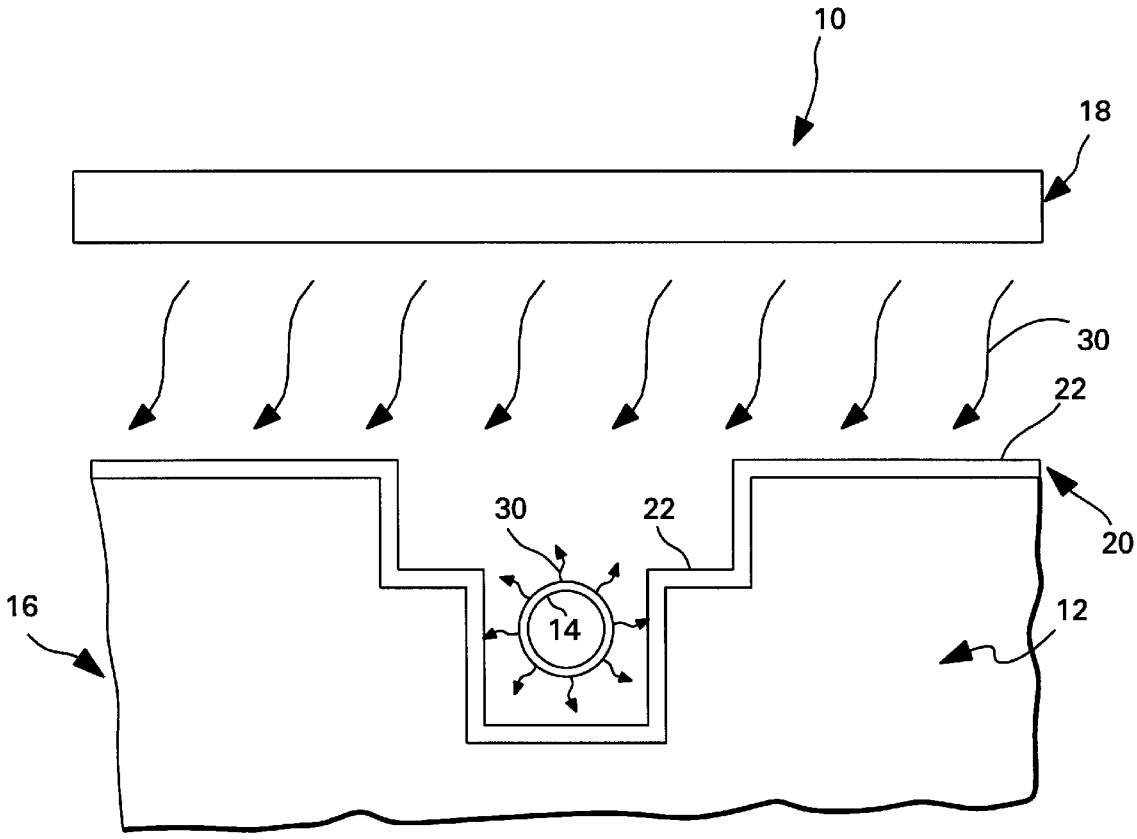
FIG. 2 is a side-sectional schematic illustration of a generalised cathode cup geometry for use in an x-ray tube, illustrating an embodiment of the invention, in which the cathode comprises an infrared reflective coating applied to it.
Figure 3:
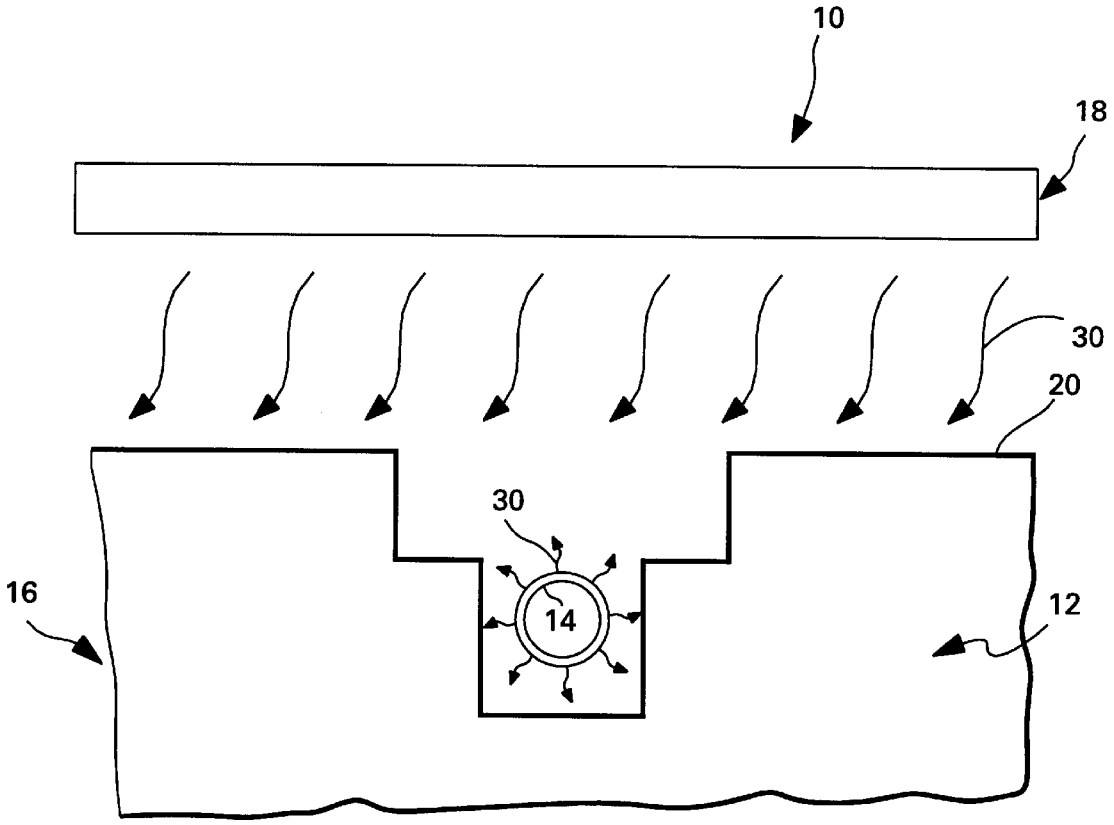
FIG. 3 is a side-sectional schematic illustration view of a generalised cathode cup geometry similar to FIG. 2, illustrating an embodiment of the invention, in which the cathode cup comprises of a monolithic material having a surface that is highly reflective in the near-infrared region, and specifically in the 0.5–2.0 μm wavelength range.

FIGS. 2 and 3 illustrate a generalised cathode cup assembly 16 within a x-ray tube 10. A filament 14 in combination with cathode cup 12 forms the cathode cup assembly 16. An anode target 18 is rotatably mounted at a predetermined location relative to the cathode cup assembly 16 within x-ray tube 10. Arrows originating from the anode target 18 and filament 14 illustrate the radiant emission 30 from both the filament 14 and anode target 18.

At typical filament operating temperatures, for example temperatures in a range from about 2400° C. to about 2800° C., the spectral radiancy for filaments may reach a maximum level at wavelengths of radiation 30 of about one micron (1 μm). Illustrated in FIG. 1, nickel, and some high-nickel alloys, have typically been used as a core material for cathode cups 12. These nickel materials generally have an intrinsic reflectivity of 0.71 at about 1 μm wavelength. Molybdenum and high molybdenum alloys, such as TZM, are frequently employed as the material for the cathode cup 12. The molybdenum materials have low intrinsic reflectivities, for example 0.64 at a wavelength of about 1 μm. These reflectivity values may undesirably result in absorption of radiation emitted from at least one of the anode 18 and the filament 14. Accordingly, to increase the reflectivity of the cathode cup 12 at wavelengths of about 1 μm, a coating of high reflectivity is disposed to the cathode cup 12. Alternatively, the cathode cup 12 can be manufactured comprising a monolithic material, wherein such monolithic material has a higher reflectivity than either TZM or nickel.

In FIG. 3, the cathode cup 12 comprises a monolithic material. Exemplary materials comprise palladium, platinum, copper, iridium, rhodium, niobium, silver, gold, tantalum and alloys thereof, all of which are or provide high near-infrared reflectivity. Also, tantalum, niobium, and alloys thereof may be used for the cathode cup 12 as these materials exhibit a combination of relatively high reflectivity, high melting point and moderate cost. The surface that is exposed to emitted radiation 30 comprises a smooth reflective surface 20 and possesses a reflectivity in excess of about 0.73 at wavelengths of approximately 1 μm. Where a cathode cup 12 is formed of a metal, which possesses the desired intrinsic reflectivity (examples of satisfactory metal elements set out in Table 1 below), for example formed by machining, turning on a lathe, or forging, its surfaces 20 typically have surface roughnesses. A cathode cup surface roughness in the range of about 32 to about 250 microns can be observed for machining by boring, reaming, or turning on a lathe. A cathode cup surface roughness in a range from about 125 to about 500 microns can be observed for forged surfaces.(Deutchman, Aaron D. et al, *Machine Design*, MacMillan Publishing Co., Inc., FIG. 4–57, pp. 211). The effective surface reflectivity of such surfaces is less than the intrinsic surface reflectivity for the metals that comprise the monolithic material. Accordingly, polishing, such as by mechanical, chemical, or electrochemical means, provides a surface finish of less than 30 microns, and can provide an effective surface reflectivity for the intrinsic reflectivity of the monolithic metal or metals.

The cathode cup 12 illustrated in FIG. 2, illustrates a near-infrared high reflective surface 20. The surface 20 can be formed by disposing a coating 22 on the cathode cup member 12. The disposing can be done by a method discussed below.

The cathode cup 12 comprises a metal alloy such as TZM, nickel alloy, a stainless steel, or other analogous material, with an ability to withstand temperatures of at least 600° C. A suitable coating 22 for the desired near-infared reflectivity properties can be from coatings listed in Table 1. Table 1 below sets out a number of elemental metals having normal-incidence reflectivities in excess of about 0.73 at wavelengths of about 1 μm.

TABLE 1

Intrinsic Reflectivities and Corresponding Melting Temperatures of Several Elemental Metals

| Metal | Reflectivity (λ-1 μm) | Improvement over TZM (%) | Improvement over Ni (%) | Melting Point (° C.) |
|---|---|---|---|---|
| Au | 0.99 | 35 | 28 | 1062 |
| Ag | 0.98 | 35 | 28 | 960 |
| Cu | 0.97 | 34 | 27 | 1083 |
| Al | 0.94 | 32 | 25 | 660 |
| Ta | 0.86 | 26 | 17 | 2850 |
| Rh | 0.83 | 23 | 14 | 1970 |
| Pd | 0.79 | 19 | 10 | 1560 |
| Ir | 0.79 | 19 | 10 | 2450 |
| Nb | 0.77 | 17 | 8 | 2410 |
| Pt | 0.74 | 14 | 4 | 1770 |

A cathode cup 12 comprising of TZM has relatively low near-infrared reflectivity, for example about 0.64 at wavelength of about 1 μm). The coating can be selected from the group of metals or alloys of metals comprising copper, gold, silver, niobium, rhodium, iridium, palladium, platinum, tantalum, iridium, and rhodium. A nickel or nickel alloy cathode cup 12 may be provided with a coating as above. To provide an appreciable increase in reflectivity, coatings for TZM cathode cups may comprise rhodium, tantalum, copper, silver, gold, and alloys thereof. Tantalum and rhodium or alloys thereof may be beneficial due to their high temperature stability.

A cathode cup assembly 16 should possess a desirable surface smoothness, which may influence the effective reflectivity of the coating 22 or surface of the monolithic material. In particular, the effective reflectivity of the cathode cup assembly 16 can be dependent upon not only the intrinsic reflectivity of the selected coating 22 or of the cathode cup 12, if fabricated from a monolithic material, but also on the smoothness of the surface 20. If a coating is used, the coating thickness should be equal to or greater than the average surface roughness of the cathode cup material to thereby provide a smooth surface having a reflectivity approaching the intrinsic reflectivity of the selected metallic coating 22. Also if a monolithic material is used, the surface 20 of the cathode cup 12 can be polished to provide a surface roughness of less than 30 microns, for example in the range of about 1 micron to about 16 microns, such as but not limited to less than 4 microns. This roughness provides an effective surface reflectivity approaching the intrinsic value of the metal or metals comprising the monolithic material. Similarly, reflective coatings 22 applied to cathode cups 12 may be polished to have a surface roughness as described above.

The melting temperature and vapor pressure of the coating 22 influence formation of the metallic coating 22. The coating 22 should be able to withstand cathode cup operating temperatures. For instance, although elemental aluminum has a high reflectivity, its low melting temperature (660° C.) may not be desirable for a cathode material or coating. Similarly, cathode cups or coatings comprising Ag, Cu, and Au be desirable due to high-temperature stability factors. Any number of known methods may apply a coating 22 that is applied to provide surface reflectivity. Such methods include, but are not limited to, physical vapor deposition, chemical vapor depositing, plating, thermal spray, and offer deposition and coating methods.

While various embodiments are described herein, it will be appreciated from the specification that various combinations of elements, variations or improvements therein may be made by those skilled in the art, and are within the scope of the invention.

What is claimed is:

1. An x-ray tube having a cathode cup assembly, the cathode cup assembly comprising:

a filament positioned in a cathode cup; wherein a surface of the cathode cup assembly is exposed to incident infrared radiation, the surface being adapted to reflect a substantial portion of the incident radiation, the radiation having a wavelength in a range from about 0.2 $\mu$m to about 5.0 $\mu$m.

2. The x-ray tube according to claim 1, wherein the surface has a reflectivity greater than about 0.73 at a wavelength of about 1 $\mu$m.

3. The x-ray tube according to claim 2, wherein the cathode cup comprises a monolithic material.

4. The x-ray tube according to claim 3, wherein the monolithic material comprises of a metal selected from the group comprising tantalum and niobium.

5. The x-ray tube according to claim 2, wherein the surface comprises a coating applied to the cathode cup.

6. The x-ray tube according to claim 5, the cathode cup comprises a metal selected from the group comprising molybdenum and nickel.

7. The x-ray tube according to claim 6, the cathode cup comprises a molybdenum alloy comprising approximately 0.5% titanium and 0.008% zirconium and the balance molybdenum; and the coating comprises a metallic coating selected from copper, gold, silver, tantalum, niobium, rhodium, iridium, platinum and palladium.

8. The x-ray tube according to claim 6, the cathode cup comprises a nickel alloy, the coating comprises a metallic coating selected from copper, gold, silver, tantalum and rhodium.

9. The x-ray tube according to claim 8, the coating comprises of tantalum.

10. A cathode cup for use in retaining a filament member in a x-ray tube, the cathode cup comprises:

a surface that is exposed to incident radiation, the surface being adapted to reflect a substantial portion of the incident radiation, the radiation having a wavelength in a range from about 0.2 $\mu$m to about 5.0 $\mu$m.

11. The cathode cup according to claim 10, wherein the surface has a reflectivity greater than about 0.73 at a wavelength of 1 $\mu$m.

12. The cathode cup according to claim 11, the cathode cup is formed of a monolithic material.

13. The cathode cup according to claim 10, wherein the surface comprises a coating applied to the cathode cup, the coating comprising a metallic coating having a reflectivity in excess of about 0.73 at a wavelength of about 1 $\mu$m.

14. The cathode cup according to claim 13, the cathode cup comprises a metal selected from the group comprising molybdenum and nickel.

15. The cathode cup according to claim 14, the cathode cup comprises a molybdenum alloy comprising approximately 0.5% titanium, 0.008% zirconium, and the balance molybdenum; and the coating comprises a metal selected from copper, gold, silver tantalum, niobium, rhodium, iridium, palladium and platinum.

16. The cathode cup according to claim 13, the cathode cup comprises nickel, and the coating comprises a metal selected from copper, gold, silver tantalum, and rhodium.

17. The cathode cup according to claim 16, the metallic coating comprises tantalum.

18. A method of manufacturing a cathode cup for use in an x-ray tube, the method comprising:

forming a surface on a cathode cup, in which the cathode cup is exposed to incident infrared radiation, the surface being sufficient for reflecting a substantial portion of the incident radiation having a wavelength in a range from about 0.2 $\mu$m to about 5.0 $\mu$m.

19. The method according to claim 18, wherein the step of forming comprises forming the cathode cup from a monolithic material, wherein the surface comprises a reflectivity greater than about 0.73 at a wavelength of about 1 $\mu$m.

20. The method according to claim 19, wherein the step of forming comprises forming the monolithic material comprising a metal selected from tantalum and niobium.

21. The method according to claim 18, the step of forming the surface comprises applying a coating on the cathode cup, the coating having a reflectivity greater than about 0.73 at a wavelength of about 1 $\mu$m.

22. The method according to claim 21, wherein the step of forming comprises forming the cathode cup of a metallic alloy, and applying the coating to the cathode cup.

23. The method according to claim 21, wherein the step of forming comprises forming the cathode cup comprises forming the cathode cup from a molybdenum alloy comprising about 0.5% titanium, 0.008% zirconium, and the balance molybdenum; the coating comprising a metal selected copper, gold, silver, tantalum, niobium, rhodium, iridium, palladium and platinum.

24. The method according to claim 21, wherein the step of forming comprises forming the cathode cup of nickel, and forming the coating from a metal selected from copper, gold, silver, tantalum, and rhodium.

25. The method according to claim 24 wherein the step of forming comprises forming the coating comprising tantalum.

26. The method according to claim 19, wherein the step of forming comprises forming the cathode cup surface to an average surface roughness less than about 30 microns.

27. The method according to claim 21, wherein the step of forming the cathode cup further comprises polishing the cathode cup surface to a surface roughness less than about 30 microns prior applying a coating.

28. The method according to claim 21, wherein the step of forming further comprises polishing the coating to a surface roughness of less than about 4 microns.

29. The method according to claim 21, wherein the step of forming comprises forming the surface having an average surface roughness, and applying the coating to the surface having a thickness in excess of a maximum value of the average surface roughness.

* * * * *